United States Patent [19]

Mutoh

[11] Patent Number: 4,630,758

[45] Date of Patent: Dec. 23, 1986

[54] LIQUID TANK

[75] Inventor: Masayuki Mutoh, Machida, Japan

[73] Assignee: Minolta Camera Kabushiki Kaisha, Osaka, Japan

[21] Appl. No.: 463,544

[22] Filed: Feb. 3, 1983

[30] Foreign Application Priority Data

Feb. 20, 1982 [JP] Japan ..... 57-26477

[51] Int. Cl.[4] ..... B67D 3/00

[52] U.S. Cl. ..... 222/189; 222/422; 222/481; 222/564; 346/140 R

[58] Field of Search ..... 222/420, 422, 547, 564, 222/478, 481, 189; 346/140 DD

[56] References Cited

U.S. PATENT DOCUMENTS

| | | | |
|---|---|---|---|
| 3,189,223 | 6/1965 | Mackal | 222/420 X |
| 3,248,017 | 4/1966 | Allen | 222/420 X |
| 3,335,767 | 8/1967 | Manas | 222/440 X |
| 3,887,928 | 6/1975 | Ohno et al. | 346/140 |
| 3,933,272 | 1/1976 | Lamb et al. | 222/440 X |
| 3,968,498 | 7/1976 | Uchiyama | 346/29 |
| 4,095,237 | 6/1978 | Amberntsson et al. | 346/140 PD |
| 4,183,030 | 1/1980 | Kaieda et al. | 346/140 |
| 4,317,473 | 3/1982 | Gaydos | 222/420 X |

FOREIGN PATENT DOCUMENTS

| | | | |
|---|---|---|---|
| 280526 | 4/1914 | Fed. Rep. of Germany | 222/478 |

*Primary Examiner*—Joseph J. Rolla
*Assistant Examiner*—Frederick R. Handren
*Attorney, Agent, or Firm*—Wenderoth, Lind & Ponack

[57] ABSTRACT

A liquid tank structure for reducing hydrostatic pressure at an outlet thereof. The structure has a liquid container having an outlet at its lower portion, and a capillary member within the liquid container for exerting a force on a liquid therein in a direction opposite to the hydrostatic pressure of the liquid at the outlet for reducing the hydrostatic pressure at the outlet.

3 Claims, 9 Drawing Figures

LIQUID TANK

FIELD OF THE INVENTION

The present invention relates to a liquid tank having an outlet at its lower portion, and more particularly to a liquid tank which is adapted to minimize the variation of liquid pressure at its outlet when the level of the liquid within the tank changes as the liquid flows out through the outlet.

BACKGROUND OF THE INVENTION

Conventional devices including as a part thereof a liquid tank having an outlet at a lower portion thereof include ink jet devices, such as the one disclosed in detail in the specification of U.S. Pat. No. 4,183,030, Jan. 8, 1980. The disclosed device comprises an ink tank having at its bottom a nozzle made of a thin metal pipe for guiding ink from the interior of the tank to the outside. By virtue of the hydrostatic pressure of the ink and a bias voltage impressed across the nozzle and an opposed electrode, the ink is held in a ready state, forming a meniscus at the nozzle tip. When a switching voltage is applied across the nozzle and the electrode, the ink is forced out from the nozzle in the form of a jet.

With this device, a reduction in the amount of ink in the tank causes a variation in the hydrostatic pressure at the nozzle, directly effecting the outflow of ink, such that when the ink jet device is used as a recording head, the amount of jetted ink is reduced to a degree which produces variations in the density of the recorded characters, in the size or width of drawn lines or in the ink atomizing frequency, consequently resulting in various defects such as deformed recorded characters, illegible characters, delayed responsiveness of the ink jet and recorded characters of impaired quality.

Accordingly in order to reduce the variations of hydrostatic pressure to the greatest possible extent, it has been attempted, for example, to use a tank having an increased bottom area and a reduced height. However, serious problems are still encountered when using such a device. For instance, if the ink jet device is used as the recording head of an X-Y plotter, there is a limitation on the increase in the size of the bottom area. Accordingly, in this case in which a capacity of the tank can not be increased, it may render one recording head unusable for a prolonged period of continuous time.

SUMMARY OF THE INVENTION

The main object of the present invention is to provide a liquid tank which is adapted to contain an increased amount of liquid without increasing the bottom area of the tank more than is needed and further without increasing the pressure at the outlet beyond an allowable range.

Another object of the invention is to provide a liquid tank capable of containing a liquid above an "allowed liquid level" which is determined in relation with the liquid pressure at the outlet of the tank.

Still another object of the invention is to provide a liquid tank which is so constructed that the pressure of liquid at its outlet is approximately constant independent of the liquid level.

These objects can be fulfilled by providing within a container having an outlet at its lower portion a capillary member for exerting a force on the liquid in the tank in a direction opposite of the hydrostatic pressure of the liquid at the outlet so as to reduce the hydrostatic pressure at the outlet. The capillary member can be provided at a position where the member acts only on the portion of the liquid in the tank above the allowed level. The capillary member can have such properties that the capillary action thereof on the liquid increases from portion to portion upward. More specifically, the capillary member can be made, for example, of a foamed porous metal in which the apparent mean pore size gradually decreases from portion to portion in the upward direction, or the capillary member can comprise several kinds of foamed metals superposed in layers in which the pore size decreases from layer to layer in the upward direction.

BRIEF DESCRIPTION OF THE DRAWINGS

The invention will now be described in greater detail in connection with the accompanying drawings, in which.

DETAILED DESCRIPTION OF THE INVENTION

Figure 1:
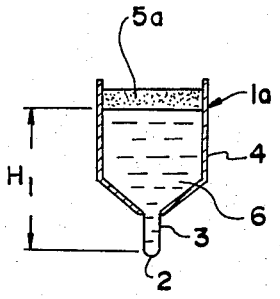
FIG. 1 is a sectional elevation view showing a first embodiment of the invention.

In FIG. 1, liquid tank 1*a* comprises a container 4 provided at its bottom with a nozzle 3 having an orifice 2 at the lower end and serving as an outlet for container 4, and a capillary member 5*a* positioned at a suitable height $H_1$ above the orifice 2 and positioned so as to be in intimate contact with the inner wall surface of the container 4. The capillary member 5*a* exerts an upward capillary force on a liquid 6 within the container 4. (This action will hereinafter be referred to as "capillary action.") The capillary member 5*a* is made, for example, of "CELMET" (trademark, product of Sumitomo Electric Industries, Ltd., Japan).

When the hydrostatic pressure at the plane across the orifice 2 tends to increase beyond an allowable value due to a rise of the liquid level within the container 4 above the height $H_1$, the capillary action functions to reduce the increase and decrease in the variation of the hydrostatic pressure due to the variation of the liquid level.

A description will be given of the variation of the hydrostatic pressure P at the plane across the orifice 2 of the liquid tank 1*a* of the above construction.

The pressure $P_1$ produced at the plane across the orifice 2 by the liquid 6 in the container 4 due to gravity is given by the expression:

$$P_1=\rho g H_1.$$

wherein $\rho$ is the density of the liquid 6, and g is the acceleration due to gravity.

Figure 2:
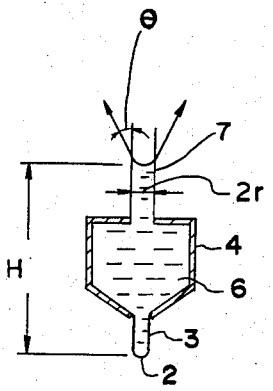
FIG. 2 is a sectional elevation view showing a simplified model of the first embodiment used for calculation of operational results.

The capillary force $P_2$ acting on the liquid 6 is calculated as follows. To simplify the problem, the capillary member 5*a* is assumed to be a single capillary tube 7, as shown in FIG. 2, equivalent to the capillary passages in the capillary member 5*a*. With reference to the drawing, assuming that the contact angle between the liquid 6 and the capillary tube 7 is $\theta$, the radius of the capillary tube 7 is r, the distance between the plane of orifice 2 and the free surface of the liquid 6 is H, and the surface tension of the liquid 6 is $\sigma$, then when $O \leqq H < H_1$, no capillary force $P_2$ occurs, so that $$P=P_1=\rho g H.$$

when $H \geqq H_1$, $$P_2 = -(2\pi r \cdot \sigma \cos\theta)\cdot(\pi r^2)^{-1}$$
$$= -2r^{-1}\sigma\cos\theta.$$

Accordingly the hydrostatic pressure P is given by:

$$P = P_1 + P_2$$
$$= \rho g H - 2r^{-1}\sigma\cos\theta.$$

The minus sign of the capillary force $P_2$ indicates that the force acts upward. Thus when the liquid level is not lower than the specified level (i.e., $H_1$ in the present embodiment), the capillary force $P_2$ acts to reduce the variation of the hydrostatic pressure P by the corresponding amount.

As already mentioned, r represents the radius of the capillary tube 7 equivalent to the capillary member 5*a*. The radius r will hereinafter be referred to as the "radius of the equivalent capillary tube".

The above embodiment will be described below more specifically with the use of numerical values.

An exemplary case will be considered in which the allowable range of hydrostatic pressure P is 2.0 cm Aq to 3.5 cm Aq.

Figure 3:
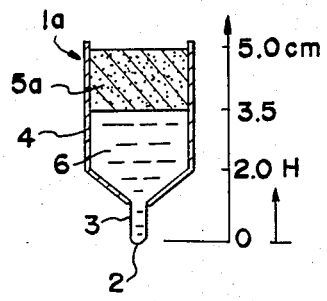
FIG. 3 is a sectional elevation view showing a specific example of the first embodiment.

As seen in FIG. 3, it is assumed that the upper end of the nozzle 3, and the lower surface and the upper surface of the capillary member 5*a* are 2.0, 3.5 and 5.0 cm, respectively, above the plane across the orifice 2 and that the capillary member 5*a* has a radius of the equivalent capillary tube, r, for producing a capillary force $P_2$ of:

$$P_2=-2r^{-1}\sigma\cos\theta=-1.5 \text{ cm Aq.}$$

Figure 4:
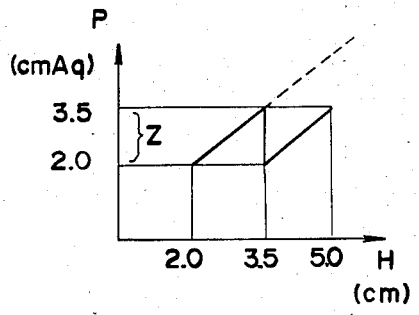
FIG. 4 is a diagram showing variations in hydrostatic pressure in the embodiment of FIG. 3.

(When $\sigma=29$ dynes/cm, $\cos\theta\approx1$, $\rho=1$ gr/cm$^3$, and $g=980$ cm/sec$^2$, $r\approx0.4$ mm.) The relation between the liquid level H above the orifice plane and the hydrostatic pressure P is then represented as shown in FIG. 4. Thus if there is no capillary member 5*a*, if the liquid level H within the container 4 exceeds 3.5 cm, the hydrostatic pressure P increases beyond the allowable range Z as indicated by the broken line in FIG. 4. On the other hand in the case of the present embodiment where the capillary member 5*a* is provided, the capillary action of the capillary member 5*a* reduces the hydrostatic pressure P from the broken line value by 1.5 cm Aq, with the result that the hydrostatic pressure P remains within the allowable range Z until the liquid level H reaches 5.0 cm. Consequently the amount of liquid 6 which can be stored in the container 4 can be increased two-fold by the capillary member 5*a* having the same cross sectional area as that of the container.

Figure 5:
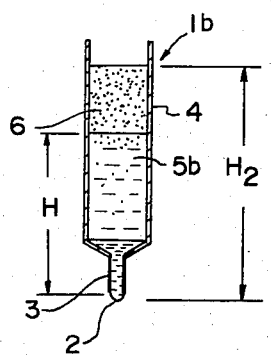
FIG. 5 is a sectional elevation view showing a second embodiment.

Next, a second embodiment will be described with reference to FIG. 5.

Figure 6:
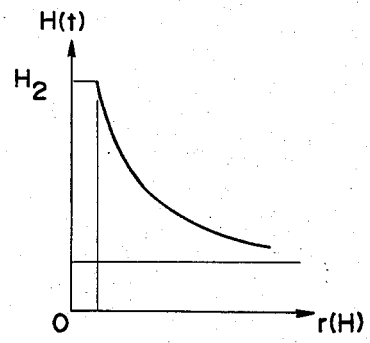
FIG. 6 is a diagram showing the effect of varying the radii of equivalent capillary tubes in the second embodiment.

The liquid tank 1*b* of this embodiment is provided with a capillary member 5*b* packed therein from the top of a nozzle 3 to a specified height $H_2$ and having a radius of the equivalent capillary tube, r, which increases upward, such that the hydrostatic pressure P at the plane across the orifice 2 is maintained at a constant value irrespective of the liquid level H. When P=K (constant) in the last-mentioned equation for P as set forth above the radius of the equivalent capillary tube, r, is expressed by:

$$r(H)=2\sigma\cos\theta/(\rho g)\cdot[H(t)-K/(\rho g)]^{-1}$$

where the radius of the equivalent capillary tube, r(H), is a function of the liquid level H, and H(t) shows that the liquid level, which lowers with the outflow of the liquid 6, is a function of time t. The variation of the radius r(H) of the above equation relative to the liquid level H is represented by a hyperbolic curve as shown in FIG. 6; the radius r(H) decreases with the rise of the liquid level H.

Now numerical values will be substituted in the above equation for an exemplary case.

Suppose $\sigma=29.0$ dynes/cm, $\cos\theta\approx1$, $\rho=1$ gr/cm$^3$ and $g=980$ cm/sec$^2$ and it is desired to maintain P at 3 cm Aq. The radius r(H) is given by:

$$r(H)=0.05[H(t)-3]^{-1}$$

While the initial position $H_2$ of the liquid level H(t) is optional, it is assumed that $H_2$ is 6 cm. The radius of the equivalent capillary tube, $r(H_2)$, i.e., the radius $r(H_2)$ at the uppermost portion of the container 4, is smallest and is 0.2 mm.

Figure 7:
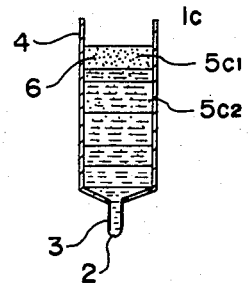
FIG. 7 is a sectional elevation view showing a third embodiment.

Whereas the radius of the equivalent capillary tube, r(H), of the capillary member 5*b* according to the second embodiment varies continuously with the liquid level H, FIG. 7 shows a liquid tank 1*c* according to a third embodiment, wherein several kinds of capillary member $5c_1$, $5c_2$, . . . having varying radii of the equivalent tube, $r_1$, $r_2$, . . . are arranged one above the other so as to constitute layers in a container 4, with the respective radii $r_1$, $r_2$, . . . decreasing in the upward direction.

Porous materials, such as foamed metals having varying pore sizes (e.g. CELMET mentioned above), sintered materials, or mesh screens having capillary action can be superposed in layers to provide an assembly of the capillary members.

Figure 8:
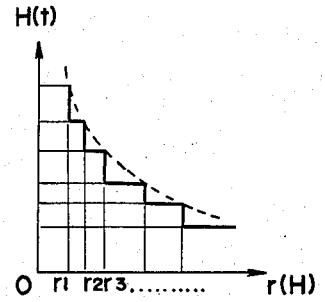
FIG. 8 is a diagram showing the effect of varying the radii of equivalent capillary tubes according to the third embodiment.

The radius of the equivalent capillary tube, r(H), of the third embodiment varies with the liquid level H stepwise as indicated by the solid line in FIG. 8.

The liquid tank of this invention can be used as the ink tank of the ink jet device disclosed in the specification of the aforementioned U.S. Pat. No. 4,183,030. The liquid tank is effective for attenuating the heaving of the liquid level as described in that specification and also for minimizing the variation of the hydrostatic pressure in the nozzle due to the variation of the liquid level by exerting capillary action on the liquid.

Figure 9:
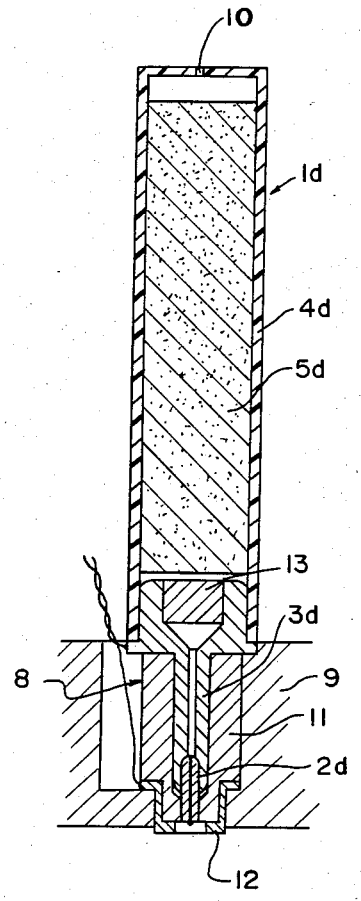
FIG. 9 is a sectional view showing an ink tank for an ink jet device and incorporating the present invention.

FIG. 9 shows an embodiment for use as the ink tank of such an ink jet device. The ink tank 1*d* comprises a vertically elongated tubular container 4*d* and a nozzle assembly 8 removably mounted on the lower end of the container 4*d* in communication with the interior thereof. The tank is mounted on the main body 9 of a recording head.

The container 4*d* has a capillary member 5*d* packed therein and a port 10 in its top for maintaining the surface of ink at atmospheric pressure.

The nozzle assembly 8 comprises a nozzle 3*d* serving as a high-voltage electrode to which signals are applied, a nozzle chip 2*d* providing an orifice at the forward end of the nozzle 3*d*, and an opposed annular grounding electrode 12 attached to the tip of the nozzle chip 2*d* and insulated from the nozzle 3*d* and the chip 2*d* by a spacer 11.

A filter 13 is inserted in the inlet end of the nozzle 3*d*.

The container 4*d* is useful not only for ink jet devices but also for other devices, for example, as a cartridge for writing implements.

As will be apparent from the foregoing description, the container of the invention has a bottom outlet and a capillary member placed in the container for exerting capillary action on the liquid in the container, so that the variation of hydrostatic pressure at the bottom of the container due to the variation of the liquid level can be adjusted suitably. For example, even when the hydrostatic pressure at the lower portion of the container is limited to an allowable range, the container can be adapted to contain an increased amount of liquid.

The capillary member forming part of the second or third embodiment exerts capillary action which varies gradually from portion to portion along the height of the container. In this case, the hydrostatic pressure can be maintained approximately at a constant value at all times even if the liquid level changes due to a reduction in the amount of liquid in the container. When the container is used, for example, as the ink tank for an ink jet device or an X-Y plotter, the heaving of the liquid level due to the movement of the ink tank can be mitigated, while the amount of ink to be discharged can be kept constant irrespective the liquid level, thereby making it possible to produce distinct characters and images. Thus the present invention has many distinct advantages.

What is claimed is:

1. A liquid tank structure for reducing hydrostatic pressure at an outlet thereof, comprising a liquid container having an outlet at its lower portion, a capillary member within said liquid container for contacting a liquid therein to exert an upward force on the liquid for reducing the hydrostatic pressure at the outlet, said capillary member having a gradually decreasing apparent mean pore size in the upward direction.

2. A liquid tank structure for reducing hydrostatic pressure at an outlet thereof, comprising a liquid container having an outlet at its lower portion, a capillary member within said liquid container for contacting a liquid therein to exert an upward force on the liquid for reducing the hydrostatic pressure at the outlet, said capillary member comprising a plurality of foamed metal portions superposed in layers on each other and the pore sizes of which decrease from layer to layer in the upward direction.

3. A liquid tank structure for reducing hydrostatic pressure at an outlet thereof, comprising a liquid container having an outlet at its lower portion, a capillary member within said liquid container for contacting a liquid therein to exert an upward force on the liquid for reducing the hydrostatic pressure at the outlet, said capillary member being a foamed porous metal piece having a gradually decreasing apparent mean pore size in the upward direction for exerting a capillary action on the liquid which increases in the upward direction.

* * * * *